United States Patent [19]

Dowell

[11] Patent Number: 4,458,610

[45] Date of Patent: Jul. 10, 1984

[54] FOLDING APPARATUS

[75] Inventor: Charles W. Dowell, Winston-Salem, N.C.

[73] Assignee: Consolidated Foods Corporation, Winston-Salem, N.C.

[21] Appl. No.: 438,301

[22] Filed: Nov. 1, 1982

[51] Int. Cl.[3] ..... D05B 35/02

[52] U.S. Cl. ..... 112/147

[58] Field of Search ..... 112/147, 141, 153

[56] References Cited

U.S. PATENT DOCUMENTS

| | | | |
|---|---|---|---|
| 1,531,024 | 3/1925 | Phillips | 112/147 |
| 1,664,079 | 3/1928 | Mann . | |
| 1,741,866 | 12/1929 | Mann . | |
| 2,133,225 | 10/1938 | Goodwin | 112/147 |
| 2,593,589 | 4/1952 | McIntyre | 112/147 X |
| 2,725,838 | 12/1955 | Galkin | 112/147 |
| 2,972,317 | 2/1961 | Ashe | 112/147 |
| 3,922,978 | 12/1975 | Smith | 112/147 |

*Primary Examiner*—Werner H. Schroeder
*Assistant Examiner*—Andrew M. Falik
*Attorney, Agent, or Firm*—Charles Y. Lackey; William S. Burden

[57] ABSTRACT

A folding apparatus for a sewing machine which includes a first guide for folding a marginal edge portion of fabric to define a pocket or hem and a second guide for directing a relatively narrow web or strip from an area remote to an operator work area to an area partially within the first guide. A portion of the first guide defines a slot which permits a portion of the narrow web to extend into abutment with fabric defining the pocket such that the fabric and web feed to the sewing machine as one component.

10 Claims, 7 Drawing Figures

FOLDING APPARATUS

BRIEF SUMMARY AND OBJECTS OF THE INVENTION

This invention relates generally to folders and more particularly to a folder where a pocket is formed in fabric being advanced to sewing instrumentalities of a sewing machine and wherein a strip is directed into the pocket.

The folder includes a guide means for folding a marginal edge of the fabric to form a hem or pocket and guide means for directing a relatively narrow strip or web into the pocket. While the strip may be of various widths and constructed of various selected materials, in a preferred embodiment, the strip is formed of rubber or other suitable elastic constructions.

The strip guide means is an integral part of the fabric foldover process and includes a first guide section disposed at approximately a right angle with respect to the direction of movement of fabric through the fabric guide means, and a second guide section for guiding the strip generally in the same direction as the fabric. At least a portion of the second section of the strip guide means cooperates with the fabric guide means to define a channel for the strip material. The channel narrows adjacent the feed-out ends to a width slightly narrower than the strip width.

The fabric guide means has portions defining a slit adjacent the exit end which permits the strip located within the guide channel to move into abutment with the inner marginal edge of the fabric, thus the fabric and strip feeding as one component to the sewing instrumentalities. When a rubber strip is used, the rubber and fabric leaving the folder feed as one component. The rubber can be run in a completely relaxed state, or if directed through a tensioning device, the fabric can be gathered by relaxation of the rubber as it leaves the sewing instrumentalities.

One of the primary objects of the invention is the provision of a new and improved folder for directing a relatively narrow strip into a fold or pocket of a fabric.

Another object of the invention is the provision of a folder for lining and directing a strip into abutment with an advancing fabric so that they feed toward the sewing instrumentalities as one component.

Other objects and advantages of the invention will become apparent when considered in view of the following detailed description.

BRIEF DESCRIPTION OF THE DRAWING

FIG. 2 is an enlarged bottom plan view of the folder illustrating the movement of the strip and fabric there through;

DETAILED DESCRIPTION OF THE INVENTION

Figure 4:
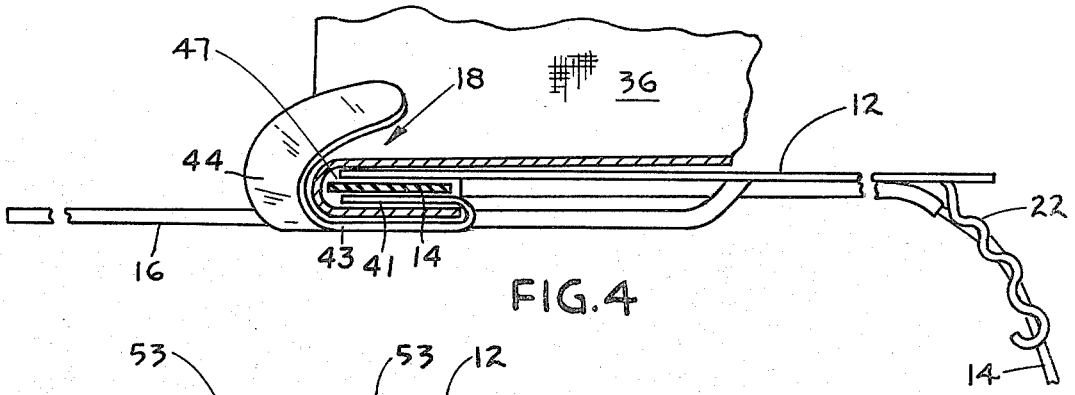
FIG. 4 is an enlarged, fragmentary, elevational view of the exit end of the folder.

Referring to the drawing, the folder 10 preferably is of metal construction having a generally rectangular fabric support plate 12, a support base 16, a fabric guide 18, a strip guide 20 and a tension device 22. The fabric support plate 12 is secured by suitable means to the support base 16. The support base is mounted upon sewing machine 28 by means of fasteners 24 such that the main fabric guide 18 is generally aligned with the stitching mechanism 26. The support base 16 includes an arm 30 which extends approximately to the center of the plate 12 for attachment to the underneath side thereof. A portion of the base 16 may also be secured directly to exterior portions of the main guide 18.

Figure 1:
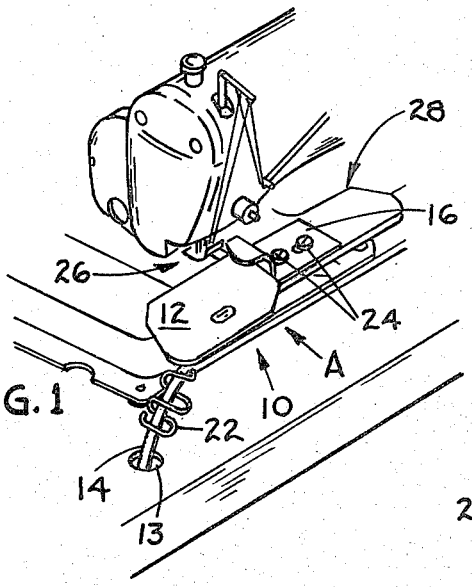
FIG. 1 is a fragmentary perspective view of a sewing machine having the folder of the present invention attached thereto.
Figure 5:
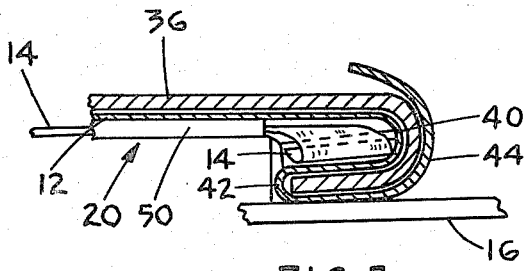
FIG. 5 is an enlarged, fragmentary view of the folder, taken along line 5—5 of FIG. 2, illustrating the change of direction of the strip and the positioning within the fabric guides.
Figure 2:
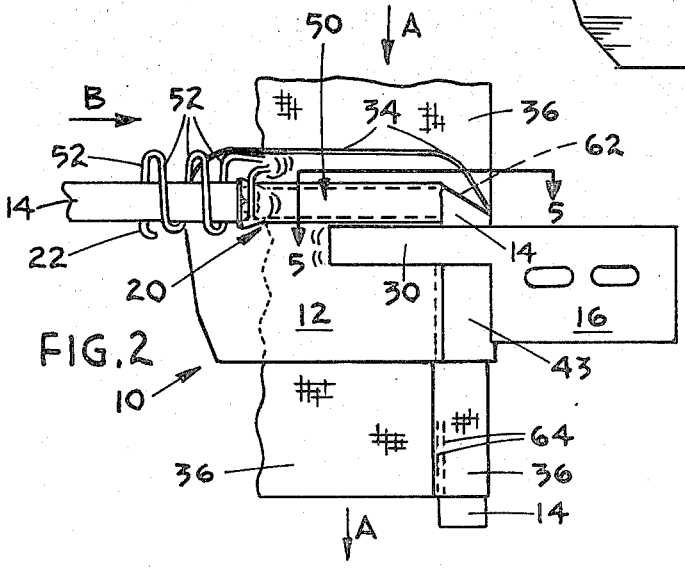
Figure 6:
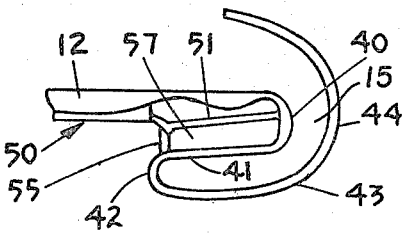
FIG. 6 is an enlarged, fragmentary view of the fabric and strip guide mechanism.

The fabric support plate 12 has downturned marginal edges 34, as shown by FIGS. 1, 2 and 6, to facilitate the folding and feeding of a piece of fabric 36 to the sewing machine stitching mechanism 26. One end of the plate 12 is configured to define the main guide 18 which includes a generally U-shaped channel 15 for receiving the fabric 36. Referring to FIGS. 5 and 6, the plate 12 is curved at 40 downwardly and inwardly. The plate is reversely curved at 42 downwardly and outwardly approximately 180° and is again curved upwardly and inwardly as at 44. Section 41 interconnecting curves 40, 42 and section 43 interconnecting curves 42, 44 are generally parallel with each other and with the uppermost surface of plate 12. The distance between sections 41, 43 and between curves 40, 44 may vary depending upon the thickness of the fabric and strip to be folded and sewn. Curved section 42 serves as a stop or abutment for an edge portion of the fabric 36.

The fabric piece 36 is advanced towards the sewing machine mechanism 26 in the direction of the arrow A, FIGS. 1 and 2, and with an edge being urged into the main guide 18 with the marginal edge abutting the curved portion 42.

The elastic strip 14 may be advanced from a suitable supply source, not shown, through the tensioning mechanism 22 and to the strip guide 20. As illustrated by FIG. 1, the strip 14 may be directed to the folder 10 through an opening 13 in the sewing machine table and then along a tortuous course due to the tensioning device 22. The strip is initially directed in the direction of the arrow B, FIG. 2, which is at an angle of 90° with respect to the direction of fabric 36.

The tensioning means 22, in the embodiment illustrated, consists of a wire member bent into a desired configuration to define a series of parallel guide segments 52. One end portion of the wire is suitably secured to the plate 12 by conventional means. To apply the desired tension to the advancing strip 14 the strip may be directed over and under a selected number of segments 52. The tensioning device 22 may be eliminated completely if so desired.

Figure 7:
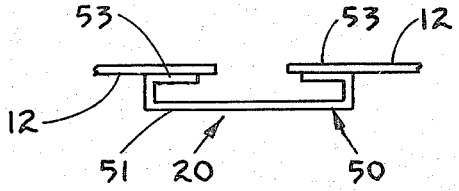
FIG. 7 is an enlarged cross-sectional view of the strip guide adjacent the entrance end thereof.
Figure 3:
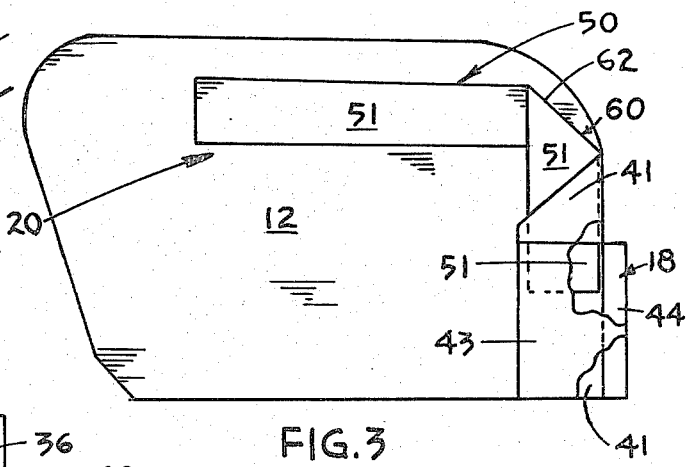
FIG. 3 is an enlarged, fragmentary, bottom plan view of the folder, with sections broken away to illustrate the various sections of the strip guide.

The guide 20 for the strip 14 includes a first section 50 which cooperates with the bottom portion of plate 12 to define a generally tubular channel. The section 50 is of generally C-shaped cross-section, as shown by FIG. 7, and includes a first surface 51 maintained in spacsed, generally parallel relation with a plate 12, by flanges 53. The section 50 is fixedly attached to the bottom side of the plate 12 by suitable means. The guide 20 includes a second section 60 FIG. 3. which serves to change the direction of a strip 14 approximately 90°. The section 60, in the embodiment illustrated, consists of a tongue-like extension of the surface 51 which is bent at generally right angles to form a diagonal guide edge 62 and extends into the space intermediate the bottom of plate 12 and the section 41 of main guide 18 as shown by FIG 6. A wall 55, FIG. 6, is provided between the section 41 of guide 18 and the plate 12 and cooperates with surface 51, section 41 and curved portion 40 to define a guide channel 57 for the strip 14. The width of the guide channel 57 narrows slightly at the feed-out end such that the width of the strip is slightly wider than the width of the feed-out end of channel 57. It is to be noted that adjacent the feed-out end of guide section 60, a portion of the plate at curved portion 40 is cut away to define a slot 47. See FIG. 4. This slot permits the strip to extend through the slot 47 from channel 57 into channel 15 of main guide 18 and over into engagement with the fabric piece 36 as both exit from the folder and facilitates feeding of the strip 14 with the fabric 36 as one component. Both the fabric 36 and strip 14 advance to the sewing instrumentalities 26 where they are secured together by stitching 64, FIG. 2. In a preferred embodiment, the strip 14 is completely encapsulated within the fold of the fabric 36, as shown by FIG. 2. However, preferably at least one line of stitching 64 passes through the strip 14.

FIG. 4 shows an elevational view of the exit end of the folder, and the fabric 36 and strip 14 as they emerge from the folder just prior to being sewn together by instrumentalities 26. Note that the left side of the strip 14 abuts the fold in the fabric 36.

The folder of the instant invention is unique in that the guide 20 is an integral part of the fabric fold-over process. The section 60 of the guide 20 cooperates with guide 18 to guide the strip 14 with the fabric 36 folded thereabout. With the guide slit at 47 at the delivery end of the folder the elastic strip and fabric are guided as one component.

If the strip 14 is of elastic material, it may be run in a completely relaxed state as it leaves the folder since it engages and feeds along with the fabric 36. If tension is applied to the elastic strip, such as by tension device 22, the fabric 36 may be gathered by relaxing the strip 14 as it leaves the machine sewing mechanism.

While sections 50 and 60 of guide 20 have been described as of integral construction, and while guide 18 has been described as integral with plate 12, the various guides and guide sections may be of discrete, separate elements.

What is claimed is:

1. Folding apparatus for a sewing machine comprising a fabric support plate, a first guide means defining a first channel adjacent one end portion of said support plate for folding an edge portion of a fabric piece to define a pocket, second guide means for directing a flexible strip to a position where said strip is at least partially positioned within the pocket of said fabric piece, said second guiding means cooperating with said first guide means to define a second channel for guiding said strip, said first guide means having portions defining a slot for permitting at least a portion of said flexible strip to extend therethrough from said second channel to said first channel of said first guide means and into abutting engagement with said fabric piece such that said one fabric piece and said strip are advanced as one component to sewing instrumentalities of a sewing machine.

2. Folding apparatus as recited in claim 1, wherein said first guide means in integral with said fabric support plate.

3. Folding apparatus as recited in claim 1, wherein said second guide means includes a first section for guiding said strip in a direction generally perpendicular to the direction of travel of said fabric piece, and a second section disposed generally 90° with respect to said first section for changing the direction of advancement of said strip to guide said strip in the same direction as said fabric piece.

4. Folding apparatus as recited in claim 3, wherein at least a portion of said first guide means generally extends around said second section of said second guide means, said first guide means and said second section of said second guide means cooperating to direct said strip into engagement with said fabric piece.

5. Folding apparatus as recited in claim 1, wherein said flexible strip is of elastic material.

6. Folding apparatus as recited in claim 1, and further including tensioning means for applying a selected, continuously constant tension to the flexible strip prior to said strip entering said second guide means.

7. Apparatus for combining an advancing fabric piece having a hem formed therein with a relatively narrow strip such that the fabric piece and strip are fed as a single component to sewing instrumentalities comprising: first guide means for folding the fabric piece in a prescribed manner, said first guide means including portions defining a generally U-shaped channel for forming a hem, and second guide means for directing the strip into the fabric hem, said second guide means including a guide section extending at least partially within said U-shaped channel and cooperating with said first guide means to define a guide channel for said strip, said strip guide channel, in a prescribed area, having a width slightly narrower than said strip width, said first guide means including portions defining a slot for permitting said strip to pass from said guide channel to said U-shaped channel, and means for applying tension to said strip as said strip moves in a direction perpendicular to said advancing fabric piece.

8. Folding apparatus for a sewing machine comprising: a support base, a fabric support plate mounted upon said base, first guide means provided at an end portion of said plate for folding a fabric piece to form a pocket therein, said first guide means having a first portion directed downwardly and inwardly beneath said plate to define one wall of a fabric guiding channel, and a second portion directed outwardly from beneath said plate and upwardly to define another wall of said fabric guiding channel, second guide means for directing a flexible strip in a prescribed manner, at least a portion of said second guide means cooperating with said first portion of said first guide means for defining a guide channel for said strip, said second guide means being positioned beneath said fabric support plate and including a first section cooperating with said plate to define a tubular strip guide and a second section having a guide surface extending generally at a right angle with respect to said first section, said second section guide surface comprising a tongue-like member positioned intermediate said fabric support plate and said first guide means first portion.

9. Folding apparatus as recited in claim 8, said first guide means first portion having a slot therein for connecting said fabric guiding recess with said guide channel for said strip.

10. Folding apparatus as recited in claim 8, and further including tensioning means for applying tension to said strip prior to said strip entering said second guide means.

* * * * *